United States Patent [19]

Brendle

[11] 4,086,799

[45] May 2, 1978

[54] INSTALLATION TOOL FOR TAPPED PLUGS

[76] Inventor: Robert Brendle, 14, rue du Ballon, 68300 Saint Louis, France

[21] Appl. No.: 775,410

[22] Filed: Mar. 7, 1977

[30] Foreign Application Priority Data

Mar. 11, 1976 France ..... 76 06990

[51] Int. Cl.[2] ..... B25D 7/00; B25B 7/00

[52] U.S. Cl. ..... 72/114; 81/302

[58] Field of Search ..... 72/391, 114; 29/243.53; 81/302

[56] References Cited

U.S. PATENT DOCUMENTS

| | | | |
|---|---|---|---|
| 3,782,165 | 1/1974 | Bosch | 72/391 |
| 3,831,424 | 8/1974 | James | 72/391 |
| 3,933,019 | 1/1976 | Underland | 72/391 |

*Primary Examiner*—C.W. Lanham
*Assistant Examiner*—Gene P. Crosby
*Attorney, Agent, or Firm*—Cushman, Darby & Cushman

[57] ABSTRACT

The present invention relates to an installation tool for securing tapped plugs onto panels. In a preferred embodiment said tool includes a threaded rod slidably supported at one end of a first lever, a link pivotably connected at its lower end to said first lever the upper end of which including an opening through which said threaded rod extends and a second lever pivotably connected to said link, said second lever including a protrusion which can cooperate with said first lever to cause the respective ends of said first lever and of said link through which said threaded rod extends to move away from each other during a first movement of both levers toward each other, said link including a protrusion which can cooperate with said second lever after a predetermined rotation of said second lever relatively to said first lever to move said respective ends of said first lever and of said link supporting said rod further away from each other. Such installation tool is used to secure tapped plugs of the pan type onto panels of various thicknesses.

4 Claims, 3 Drawing Figures

INSTALLATION TOOL FOR TAPPED PLUGS

BACKGROUND OF THE INVENTION

1. Field of the Invention

The present invention relates to an installation tool for tapped plugs.

The use of tapped plugs to support articles onto a panel when access can be gained to only one of the faces of the panel is now well known. Tapped plugs generally include a hollow cylindrical portion comprising several bow portions partially separated from each other along their length, substantially parallel to the longitudinal axis of the cylinder and connected at one end to a tapped sleeve while the other end is connected to a flange or to fixing legs acting as stops. When such a plug is to be installed, said plug is inserted into an opening in the panel and then retracted while still in the opening in the panel, that is its length is being shortened by means of a suitable device in order that the bow portions of the plug become bent against the non-accessible surface of the panel. The installation tool can then be withdrawn and a supporting screw for the article to be attached can be screwed in the plug now secured in the panel.

2. Description of the Prior Art

The present invention relates to an installation tool for securing a plug of the type described above onto a panel for securing an article onto said panel. Installation tools are presently known for securing tapped plugs onto panels of a given fixed thickness; these tools are constructed so that they exert a traction on the plug corresponding to a predetermined deformation of the plug and, if a panel relatively thin to the length of the plug is used, it is necessary to exert several traction efforts in order to achieve the complete deformation of the plug. On another hand, the effort to be exerted on the plug and, therefore, on the tool of a conventional design, is generally higher during the first stage of the bending of the bow portions of the plug than for the final stage of the deformation of the bow portions of the plug.

OBJECT OF THE INVENTION

It is an object of the present invention to provide an installation tool for tapped plugs which is used to secure tapped plugs into walls or panels of various thicknesses.

It is another object of the present invention to provide an installation tool for tapped plugswith which the force required to initiate the bending of the bow portions of said plugs and the force required to achieve the complete bending of said portions of the plug are substantially equal.

SUMMARY OF THE INVENTION

In order to achieve these objects, the present invention generally provides a tool including a rod, one end of which being formed with a screw-thread and the other end of which being provided with a stop, the retraction of said rod for securing said plug being obtained by applying forces on two cooperating levers engaging with each other successively via two separate fulcrums, said fulcrums being positioned so as to provide a change in the multiplication ratio of said levers, when the operative fulcrum changes from the first one to the second one.

According to one aspect of the invention, said two levers are connected by a link pivotably connected to each of them, said threaded rod being supported at one end of one of said levers and at one end of said link, one of the levers including a first boss (acting as the first fulcrum) for engagement with the second lever to cause a movement of the link upon a first movement of both levers towards each other, said link including a protusion acting as the second fulcrum which engages with the lever which does not support said threaded rod, only after a predetermined rotation of said one in order to achieve a further movement of the link relatively to the lever supporting said threaded rod with a lever arm of greater length than for the first movement.

According to a more specific feature of the present invention, said link is pivoted onto the lever which supports the threaded rod by a pin which is spaced from said threaded rod by a distance greater than the distance between said threaded rod and the pivot pin of the lever which does not support said threaded rod.

According to a further feature of the present invention, the first fulcrum or boss about which both levers are pivoting relatively to each other and the second fulcrum or protrusion of said link by which the link engages the arm which does not support the threaded rod, are positioned between the connecting points of both levers and said link.

The present invention will be better understood with reference to the following description of a particular embodiment and in connection with the herewith attached drawings on which:

DETAILED DESCRIPTION OF THE DRAWINGS

Figure 1:
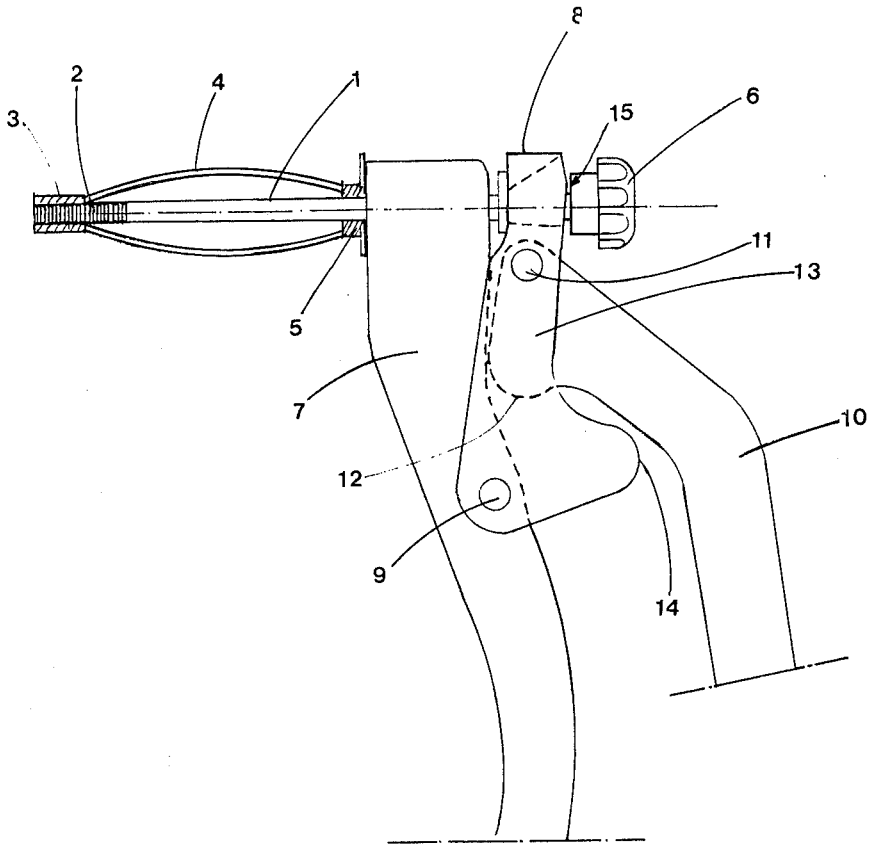
FIG. 1 is a side-view of the installation tool according to the present invention prior to the deformation of the tapped plug.

Referring now to FIG. 1, which shows a side-view of the installation tool according to the invention with a plug supported in the tool, not yet retracted, the installation tool for securing tapped plugs includes a threaded rod 1, one end of which being provided with threads 2 to cooperate with a thread formed into the bore of sleeve 3 of a plug, said plug including deformable bow portions 4 and a head acting as a stop 5. The end of the threaded rod 1 opposite to the thread 2 is connected to a knob 6 for operating said rod and especially for rotating said threaded rod.

In addition, said tool includes a lever 7, a passage, for example a bore, being formed through the upper end thereof, said threaded rod 1 being supported therethrough for rotation and/or axial movement. A link 8 is pivotably connected to said lever 7 by a pin 9, and a second lever 10 is pivotably connected to said link by a pin 11, said link being formed with an extension beyond the pin 11 said threaded rod 1 extending through an opening formed in this extension or upper end of said link. Said link 8 includes an opening which defines two spaced apart flanges receiving the lever 10 therebetween.

Said lever 10 is formed with a boss 12 acting as a first fulcrum between lever 7 and lever 10 and making it possible for lever 10 to have a rolling motion relatively to lever 7. At the lower end of said link, the two side portions 13 are inter-connected by a protrusion 14, for engagement between lever 10 and said link 8 when said lever 10 has been turned of a predetermined amount about said pin 11 and acting then as a second fulcrum for lever 10.

The operation of the tool is as follows: the sleeve of the plug is screwed in threaded rod 1, the tool is then in the position shown in FIG. 1, that is, lever 10 is away from the link protrusion 14 and cooperates through its boss 12 with lever 7.

Figure 2:
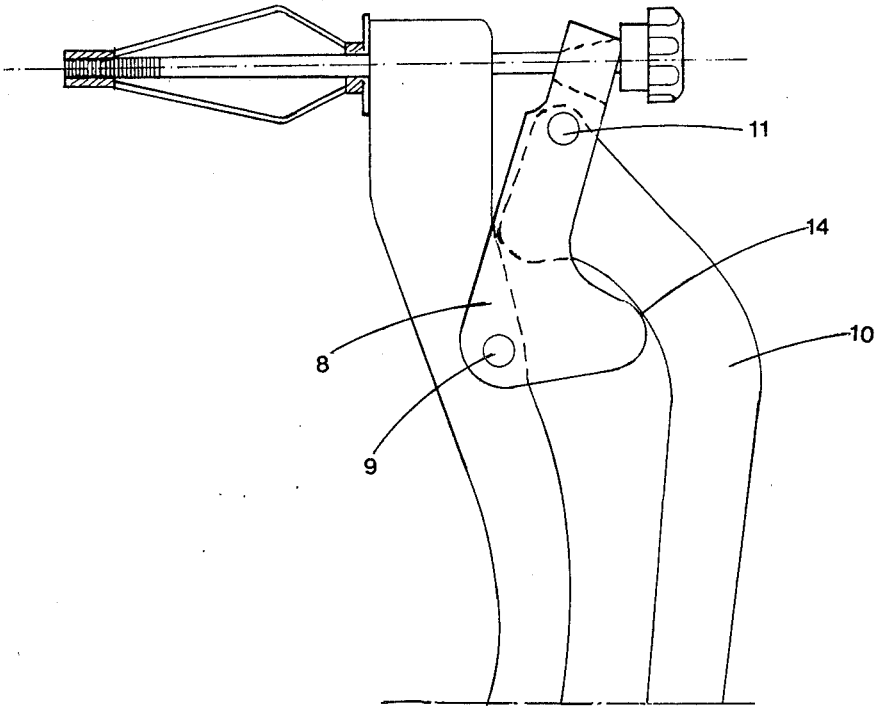
FIG. 2 is a side-view of the installation tool according to the invention after the plug has started to bend.

When a force is exerted on both levers 10 and 7, the link 8 pivots away from said lever 7 and comes into engagement with the front face 15 of said knob 6. The threaded rod 1 is then pulled rearwards to the right in FIG. 1 and the plug starts to deform or bend, as shown in FIG. 2. During this first stage of the movement the displacement of the end of said link which presses against the face 15 is related to the distance between the point of engagement between the boss 12 and lever 7 and the pin 11.

Figure 3:
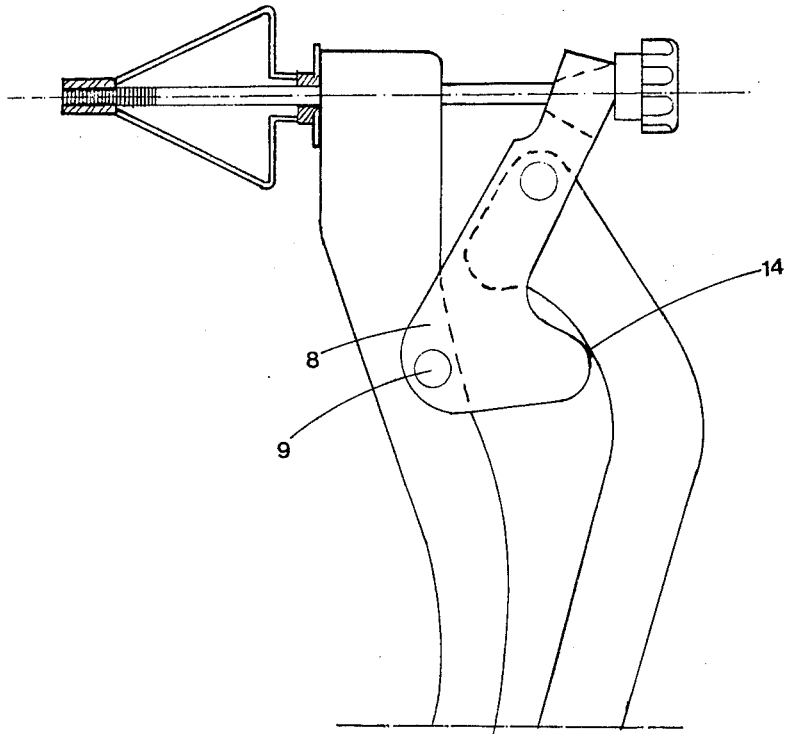
FIG. 3 is a side-view of the installation tool according to the invention shown in a position corresponding to a complete deformation of said plug.

When lever 10 has turned of a predetermined amount relatively to lever 7, it reaches the position shown in FIG. 2 wherein it engages with the protrusion 14 of said link. The link continues to pivot away from lever 7 but the amplitude of this movement is then related to the distance between the point of engagement of protrusion 14 with lever 10 and the pin 11. After some rotation which varies according to the length of the plug being used and to the thickness of the panel, the plug takes the position shown in FIG. 3, wherein the bow portions of said plug are coming into engagement with the non-accessible surface of the panel. The threaded rod 1 is then unscrewed from the plug by rotating said knob 6 and an article can then be attached to the panel by means of a screw cooperating with said tapped sleeve 3 of the plug.

Though in the specification hereinabove the plug is disclosed as fitted on the tool and not as inserted into a panel, it should be understood that prior to exerting a forces on both levers 7 and 10, the plug must be inserted into the opening or hole of said panel in order to be secured therein. The deformations of the plug as shown on the drawings may not show exactly those which actually occur but the final configuration of the plugs of this type once they are secured onto a panel are fairly similar to those shown on the drawings.

Although the boss 12 has been shown as being formed on lever 10, it should be understood that this boss could be formed on lever 7, the size of this boss on lever 7 and of the protrusion 14 on link 8 being such as lever 10 may come first into engagement with said boss on lever 7, and then, after a predetermined rotation, come into engagement with the protrusion on link 8 to actuate it with a longer operating lever arm.

In addition, although the engagement surfaces of boss 12 and of protrusion 14 have been shown as being positioned generally between pivots 9 and 11, it should be noted that these engagement surfaces could be provided below the pivot pin 9, the only difference in this case being that the force to be exerted on levers 7 and 10 should be greater than within the structure as shown. Finally, it is the difference of distance between the engagement surfaces 12 and 14 and the pivot point 11 which causes the difference of leverage during the two bending stages when securing a plug on a panel. It is therefore possible to establish such distances so that they are related to the force required to deform or bend a tapped plug. In every circumstances, the first lever arm enables to apply a large effort to the plug with a small travel of the link 8 whereas with the second lever arm, the threaded rod is pulled along a large travel, applying a smaller force to the plug, the force applied on both levers being equal in each case.

It should be noted that the present invention is susceptible of many changes and modifications. For example, in order to obtain a plurality of successive lever arms, more than 2 boss and protrusion actin as successive fulcrums can be provided at different distances. Ultimately, a continuous change of the position of the engagement point, between both levers providing a continuous variation of the leverage can be obtained by providing a protrusion in the shape of a cam which would roll onto a corresponding surface thus achieving a continuous variation of the lever arm, the engagement point of both levers of fulcrum moving as the movement of levers proceeds.

Similarly, it is not essential that a link 8 be provided. It is in fact possible to construct a lever 10 having an opening at one end through which the threaded rod is extending, both levers 7 and 10 cooperating then only by engagement of bosses or protrusion with surfaces provided on any of them. Even when a link is used, the protrusions acting as fulcums can all be provided on the levers.

The present invention is not limited to the above described embodiments but is as the contrary susceptible of variations and modifications which will appear to those skilled in the art.

What I claim is:

1. An installation tool for securing tapped plugs in place comprising: a rod threaded at one end and provided with a stop at the other end, and two levers one of them at least including a passage for said threaded rod, both levers cooperating together through at least two separate engagement surfaces which act successively as fulcrums during the movement of the levers when the tool is operated.

2. An installation tool for tapped plugs as said forth in claim 1 wherein said two levers are operatively associated via a link to which they are pivotably connected, said threaded rod extending through one end of said levers and through one end of said link and wherein said successive fulcrums are provided by two protrusions which are excentric to the connection between said link and the one lever which does not support the threaded rod, and protrusions being formed on the levers or on the link and providing thus the engagement surfaces between said two levers or between one lever and said link.

3. An installation tool for tapped plugs as said forth in claim 2 wherein said lever which does not support said threaded rod includes a first protrusion which can cooperate with the one lever that supports the threaded rod and wherein said link includes a second protrusion for cooperation with said lever which does not support said threaded rod.

4. An installation tool for tapped plugs as said forth in claim 3 wherein the sizes of the protrusions are adapted so that when both levers are moving towards each other, the first protrusion comes into engagement with the corresponding lever, whereas the protrusion provided on said link is not yet engaged with said corresponding lever and wherein, after a predetermined rotation of said levers toward each other, the protrusion of said link comes into engagement with the corresponding lever while the said first protrusion disengages from the corresponding lever.

* * * * *